US006559399B2

(12) United States Patent
Hsu et al.

(10) Patent No.: US 6,559,399 B2
(45) Date of Patent: May 6, 2003

(54) HEIGHT-ADJUSTING COLLAPSIBLE MECHANISM FOR A BUTTON KEY

(75) Inventors: Chien-Shih Hsu, Taipei (TW); Mao-Sung Huang, ChangHua (TW)

(73) Assignee: Darfon Electronics Corp., Tao Yuan (TW)

( * ) Notice: Subject to any disclaimer, the term of this patent is extended or adjusted under 35 U.S.C. 154(b) by 0 days.

(21) Appl. No.: 09/832,042

(22) Filed: Apr. 11, 2001

(65) Prior Publication Data

US 2002/0148711 A1 Oct. 17, 2002

(51) Int. Cl.[7] ..... H01H 013/70
(52) U.S. Cl. ..... 200/344; 361/680
(58) Field of Search ..... 200/341–345; 361/679–681

(56) References Cited

U.S. PATENT DOCUMENTS 5,382,762 A * 1/1995 Mochizuki ..... 200/344
6,172,868 B1 * 1/2001 Oura ..... 200/344

* cited by examiner

*Primary Examiner*—J. R. Scott
(74) *Attorney, Agent, or Firm*—Troxell Law Office PLLC

(57) ABSTRACT

A height-adjusting collapsible mechanism for a button key includes a pair of collapsible means for supporting the button key to move up or down above a substrate. At least one collapsible means has two levers pivotally crossed to form a cross angle in between. The levers have two bottom ends pivotally engaged with the substrate and spaced from each other at an interval. One of the bottom ends is located on a stopper slidable on the substrate. Moving the stopper may change the interval and the cross angle, and may thus in turn change the free height of the button key when external forcing is absent from the button key.

16 Claims, 11 Drawing Sheets

HEIGHT-ADJUSTING COLLAPSIBLE MECHANISM FOR A BUTTON KEY

BACKGROUND OF THE INVENTION

1. Field of the Invention

This invention relates to a height-adjusting collapsible mechanism for a button key and more particularly to an adjustable scissor-type linkage that is able to change a key's or a keyboard's height of a notebook computer.

2. Description of the Prior Art

In conventional notebook computers, a button key in the keyboard is usually supported thereunder by a collapsible mechanism, a rubber dome and a touch control circuit. FIG. 1 shows a typical button key mounted on a substrate 10 of a notebook computer. The button key 1 has a key top 11 for receiving external force and a collapsible means 12 which has two pairs of symmetrical scissors-type levers to support the button key 1 and thus to enable the button key 1 capable of being lifted upward or depressed downward. As shown, a hollow rubber dome 13 is located under the button key 1 and arranged between the levers to provide restore pressure for resuming the height of the button key 1 after the depressed force upon the button key 1 being released. The touch control circuit (not shown in the figure) is located on the substrate 10 under the rubber dome 13. When the key top 11 and the rubber dome 13 are free from any external force, the button key 1 is defined at a "free height" state.

In the following description, only the button key 1 and collapsible means 12 will be shown in the figures and text. The rubber dome 13 and the touch control circuit function are well known in prior art and thus will be omitted. Similar components will be marked by similar numerals in the description below to ease reading, whether they are in the prior art or belong to this invention.

FIG. 2 shows a conventional collapsible means 12 for a button key 1, located between a bottom side 110 of the key top 11 and the substrate 10. the button key 1 has a first lever 121 crossly engaged with a second lever 122 at a pivotal point 123 to form a substantially X-shaped or scissors-type linkage. Two sets of such linkage are disposed at two opposing sides of the button key 1 under the key top 11. The first lever 121 has a first top end 1211 pivotally engaged with a first hub 1101 located under the bottom side 110 and a first bottom end 1212 pivotally and slidably engaged with a turn-slide hub 101 located on the substrate 10. The second lever 122 has a second top end 1221 pivotally and slidably engaged with a second L-shaped flange 1102 located below the bottom side 110 and a second bottom end 1222 pivotally engaged with a fourth hub 102 located on the substrate 10. The first and second levers 121 and 122 thus form the collapsible means 12 that may be moved up or down under external force.

As shown, the first top end 1211 and the second bottom end 1222 are substantially located on the same first fixed vertical line L. The second top end 1221 and first bottom end 1212 are substantially located on a second vertical line L' which may be moved slightly horizontally. When the key top 11 subjects to a downward or uplift pressure, the first top end 1211 and the second bottom end 1222 are pivotally turnable respectively in the first and fourth hub 1101 and 102, while the second top end 1221 and the first bottom end 1212 are turnable and slidable respectively on the second flange 1102 and turn-slide hub 101 and may move the second vertical lines L' sideward or horizontally.

Although this mechanism may allow the button key to be lifted or lowered steadily, yet it has a fixed free height for the button key or the whole keyboard. Such a fixed free height restriction to the conventional button key structure does causes some design and usage problems. For instance, when using computers on a desktop, users mostly accustom or prefer to the standard keyboards that have button keys of greater free height. There are also some keyboard designs that would have greater free height for some special function keys (such as Tab key) than other button keys. However, in notebook computers that are highly focused to slim size and lightweight, a fixed free height button key or keyboard becomes a serious design issue.

In order to make the notebook computer more compact, the free height of button keys is used to be designed as small as possible for saving the thickness thereof, but from which the using of the keyboard would become awkward and inconvenient. To make the operation of the notebook computer more comfortable, the free height of the button key should be increased to a level for most users able to get along easily. However, to increase the free height of the button keys would definitely make the notebook computer bulky. Therefore, how to get a better design upon the aforesaid issues is still a problem begging for improvement.

SUMMARY OF THE INVENTION

It is an object of this invention to provide a height-adjusting collapsible mechanism for a button key that may make the free height for a button key or the keyboard adjustable to suit various requirements of users.

It is another objet of this invention to provide a height-adjusting collapsible mechanism that enables a notebook computer to have a greater keyboard height when in use and a smaller keyboard height when packed for storing and carrying, so that the computer may be made to a small size without sacrificing its normal function and convenience.

The height-adjusting collapsible mechanism of this invention includes a key top, a substrate and a pair of collapsible means to support the key top for up and down movement above the substrate. Each collapsible means has a first lever pivotally crossed with a second lever. Each of the first and the second levers has respectively one pivotal end for forming a first vertical connecting line above the substrate, and has respectively another pivotal end for forming a second vertical connecting line above the substrate and spaced from the first vertical connecting line in a first direction at a distance of a first interval. The bottom end of the first lever is engageable with a hub located on the substrate. The space between the first and the second vertical lines is defined as an inner side and the space beyond the second vertical line is defined as an outer side. In general, this invention includes at least one movable stopper engageable with the hub so that the first interval may be changed to result in change of the free height of the button key when the stopper is moved sideward or horizontally against the substrate.

In one aspect of the present invention, the stopper may be located in a slide groove formed in the substrate for the stopper to move sideward smoothly. The inner side may have a bordering edge for limiting the movement of the bottom end of the first lever.

In another aspect of the present invention, the stopper may have an adjusting end located at the outer side to facilitate movement of the stopper for changing the first interval and consequently changing the free height of the button key. The adjusting end may be a rigid or resilient member separately made or be integrally formed with the stopper. The resilient member may be a spring, an elastic metal strip and the like.

In a further aspect of the present invention, the substrate may have a slide groove formed therein in the first direction. The stopper is movable in the slide groove for moving the hub. The stopper may also be located on the hub which becomes movable.

In yet another aspect of the present invention, it may be applied to one or more keys in a keyboard. It may also be used for the whole keyboard. In this case, multiple number of this invention will be laid on the substrate at a selected pattern. The stoppers will be connected together and be actuated by a height-adjusting means for changing the free height of the keyboard as desired. The collapsible mechanism will have a control point to work with the height-adjusting means. The height-adjusting means may be located between the substrate and keys and may have a bordering side. The height-adjusting means may be moved to one position to make the bordering edge making contact with the control point at the free height state. Moving the height-adjusting means to another position will make the bordering side moving away from the control point, then the crossing angle between the first and the second levers will be changed for thus altering the free height of the keyboard.

In yet another aspect of the present invention, the substrate may include at least one slide rail for the height-adjusting means to slide thereon. The sliding relationship between the substrate and height-adjusting means may be a form of rail-groove or groove-rail coupling manner. The control point may be at a selected location on the lever, but is preferably at one end of the lever. The height-adjusting means may also has openings formed therein to enable the scissors mechanism passing therethrough for mounting onto the substrate. The bordering side may also be located in the openings, i.e. in the inner side.

In still another aspect of the present invention, this invention may include an actuating means to receive an external force or manual force for moving the height-adjusting means. The actuating means may include a driver end attached to the display screen of the notebook computer and a driven end attached to the height-adjusting means located in the computer body. When the notebook computer is closed with the display screen folded over the body, the driver end will move the driven end to lower the free height of the keyboard to a compact size for facilitating storage and portability. When the screen is opened and lifted, the actuating means will raise the free height of the keyboard to a higher level for adding user's comfort in using the notebook computer. The actuating means may be a cam mechanism to achieve aforesaid purpose.

BRIEF DESCRIPTION OF THE DRAWINGS

The invention, as well as its many advantages, may be further understood by the following detailed description and drawings in which.

DETAILED DESCRIPTION OF THE PREFERRED EMBODIMENTS

Figure 1:
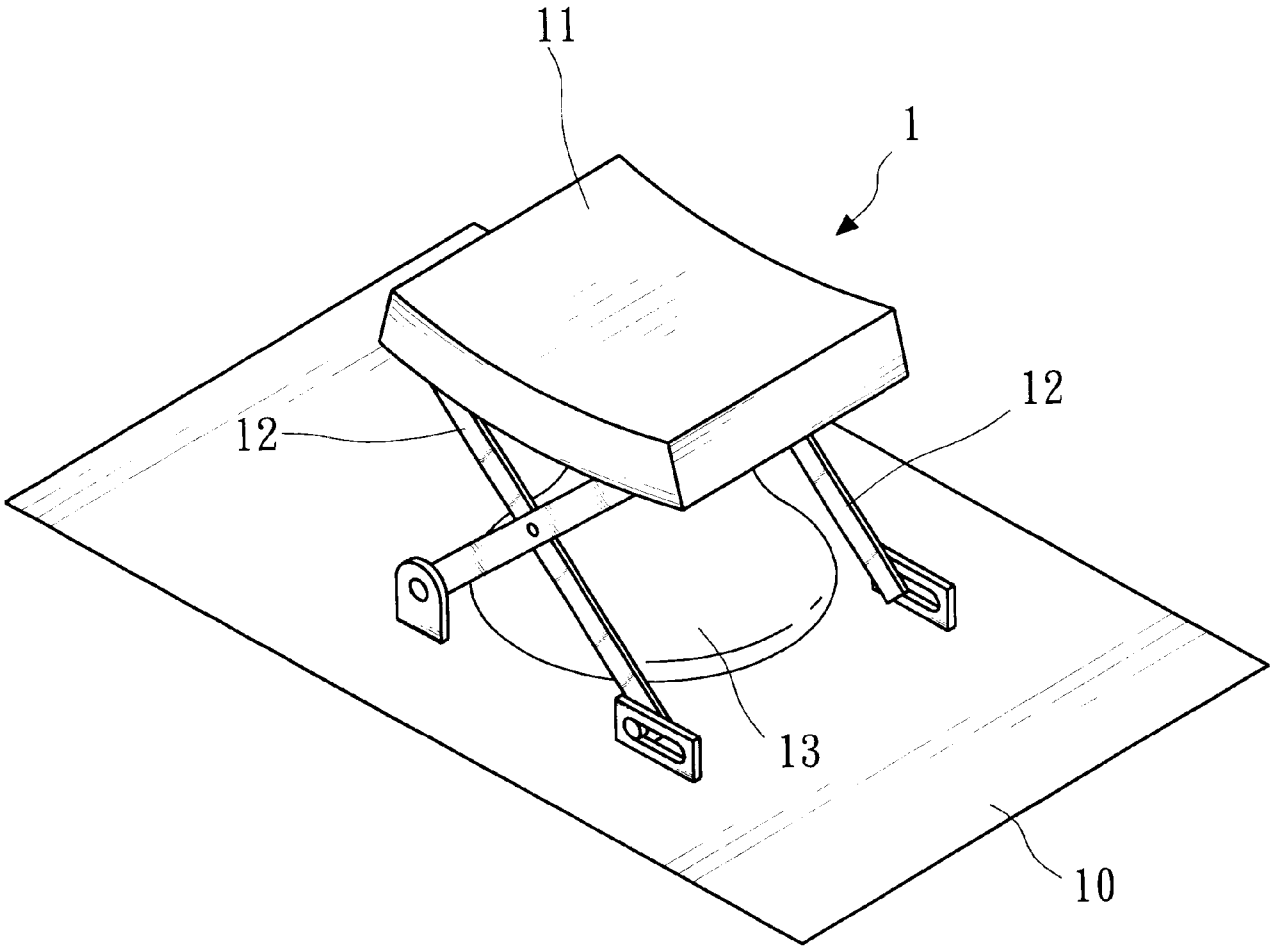
FIG. 1 (PRIOR ART)
FIG. 1 is a perspective view of a conventional collapsible mechanism for a button key.
Figure 2:
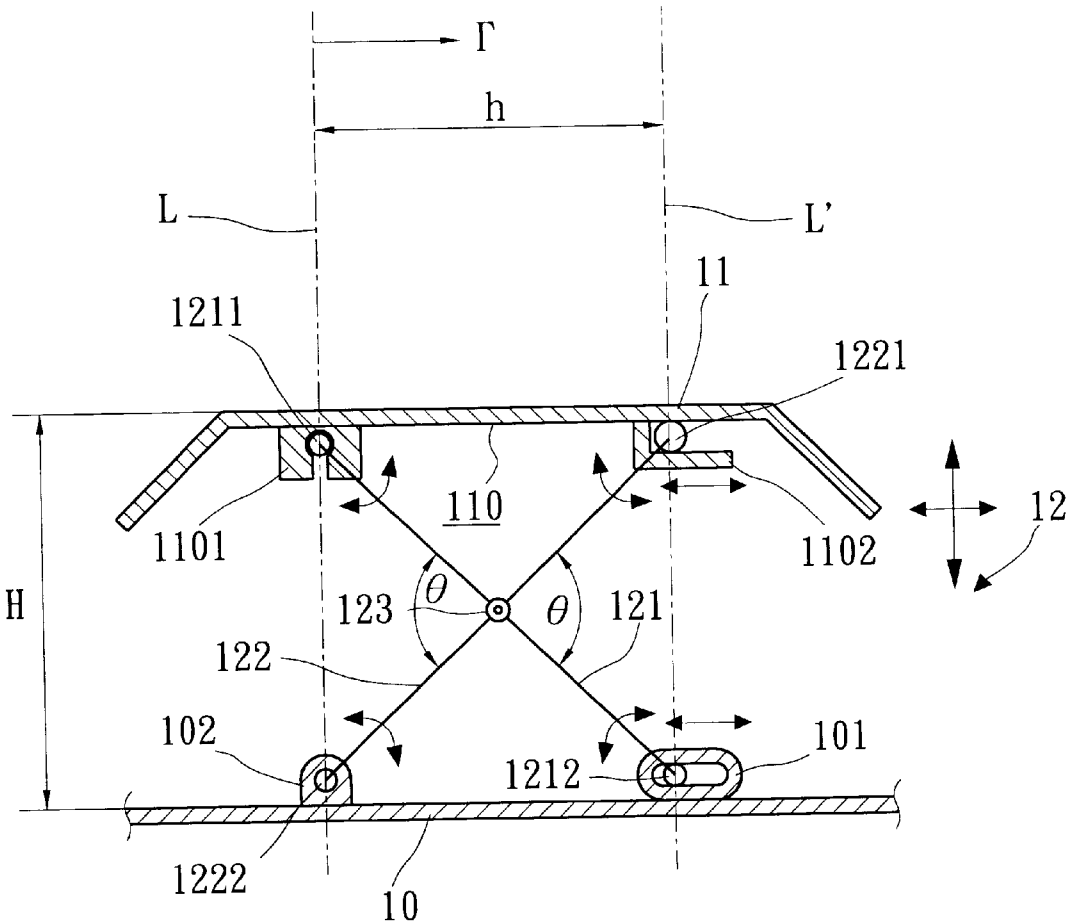
FIG. 2 (PRIOR ART)
FIG. 2 is a sectional view of a conventional collapsible mechanism for a button key.

The height-adjusting collapsible mechanism of this invention is largely constructed like the one shown in FIG. 1 and FIG. 2. In the following description, similar components will be marked by similar numerals to ease the reading of the description. A general description of the common structure will be briefly given below as the background information. The novel structure and components of this invention will be given in details later.

Like the structure shown in FIG. 1 and FIG. 2, this invention also includes a key top 11 supported by two pairs of collapsible means 12 on a substrate 10 for the key top 11 to move up or down under external pressure applying on the key top 11. Each collapsible means 12 has a first lever 121 crossly engaged with a second lever 122 at a pivotal point 123 to form a substantially X-shaped linkage with a cross angle θ. The first top end 1211 and the second bottom end 1222 are located on a first vertical line L which is fixed. The second top end 1221 and first bottom end 1212 are located on a second vertical line L' which is spaced from the first vertical line L in a first direction Γ at a distance of a first interval h. The distance between the key top 11 and the top surface of the substrate 10 when external force is absent is defined as the free height H. The space between the first and the second vertical line L and L' is defined as an inner side and the space beyond the second vertical line L' is defined as an outer side.

This invention aims at providing novel features to change the cross angle θ and the first interval h when no external force is applying on the key top 11, so that the free height H may be changed and thus be adjusted to a desired level.

Figure 3:
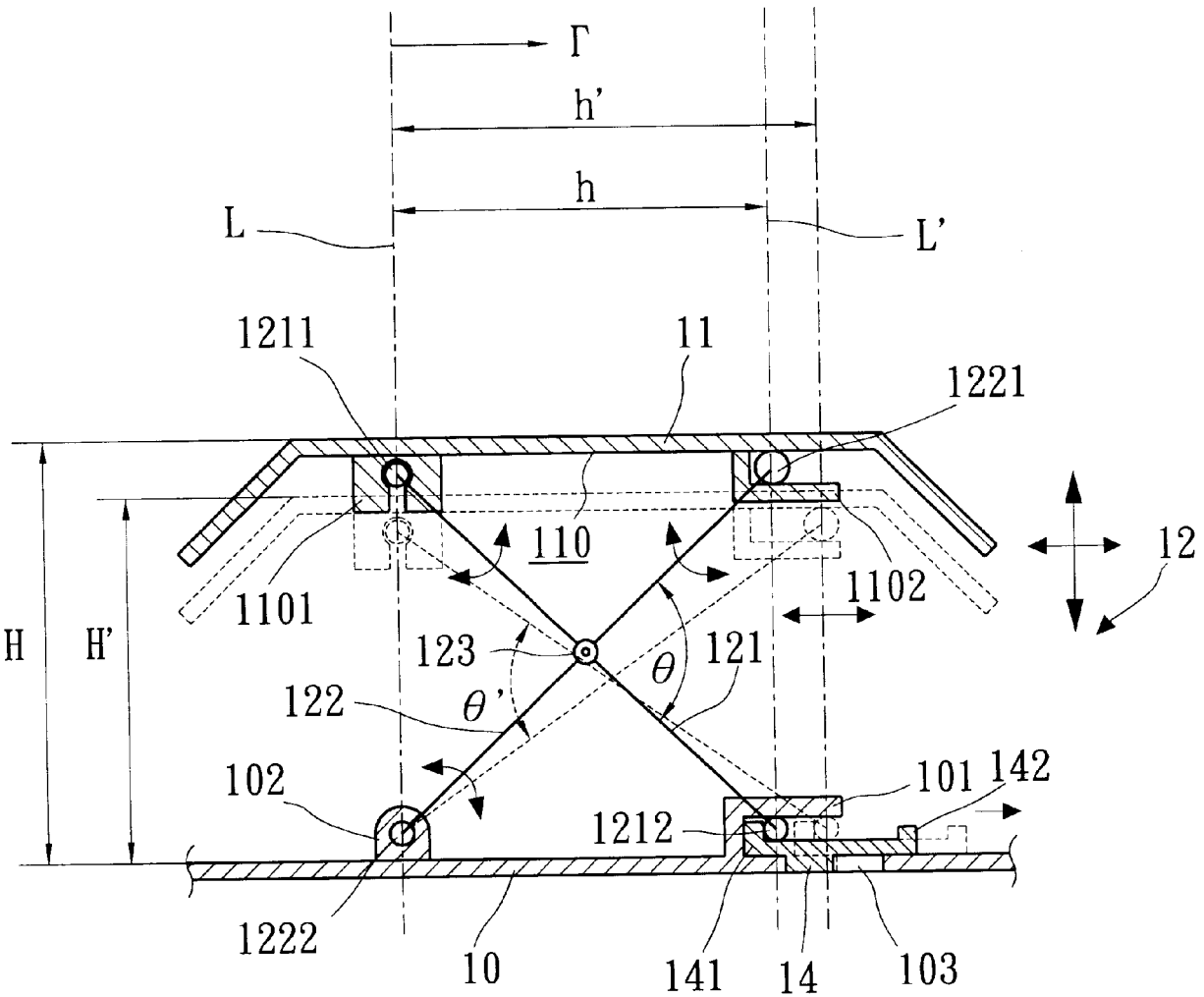
FIG. 3 is a sectional view of a first embodiment of this invention.

FIG. 3 shows the first embodiment of this invention. It is largely constructed like the one shown in FIG. 2, except that the hub for the first bottom 1212 has been changed to become a horizontal flange 101 connected to the top surface of substrate 10 by means of a vertical wall. Below the flange 101, the substrate 10 has a slide groove 103 in which there is a stopper 14 movable therein in the first direction Γ. The stopper 14 has one end formed as a bordering edge 141 against the vertical wall. The first bottom end 1212 is pivotally held in a space formed between the flange 101 and the stopper 14 against the bordering edge 141.

When the bordering edge 141 makes contact with the vertical wall (shown by solid lines in FIG. 3), the free height H is set at an initial position, and the key is operationable within the boundary of the first interval. When the stopper 14 is moved in the groove 103 in the first direction Γ, the first bottom end 1212 will also be moved sideward away from the vertical wall, the first interval h will be extended to a greater distance h' and also the cross angle θ will be changed to become a smaller cross angle θ' (shown by broken lines in FIG. 3), then the free height H will be lowered to a smaller value H'. Accordingly, the key top 11 thus may become lower. Hence, through this invention, the free height of the button key may be adjusted as desired for various purposes.

As shown in FIG. 3, the stopper 14 may further has an adjusting end 142 in the outer side to facilitate the moving of the stopper 14. Many embodiment variations may be made based on the first embodiment shown above, for instance instead of having the slide groove 103 formed in the substrate 10, the slide groove 103 may be formed in the stopper 14 to movably engage with a protruding rail formed on the substrate 10 for serving the same function and purpose.

Figure 4:
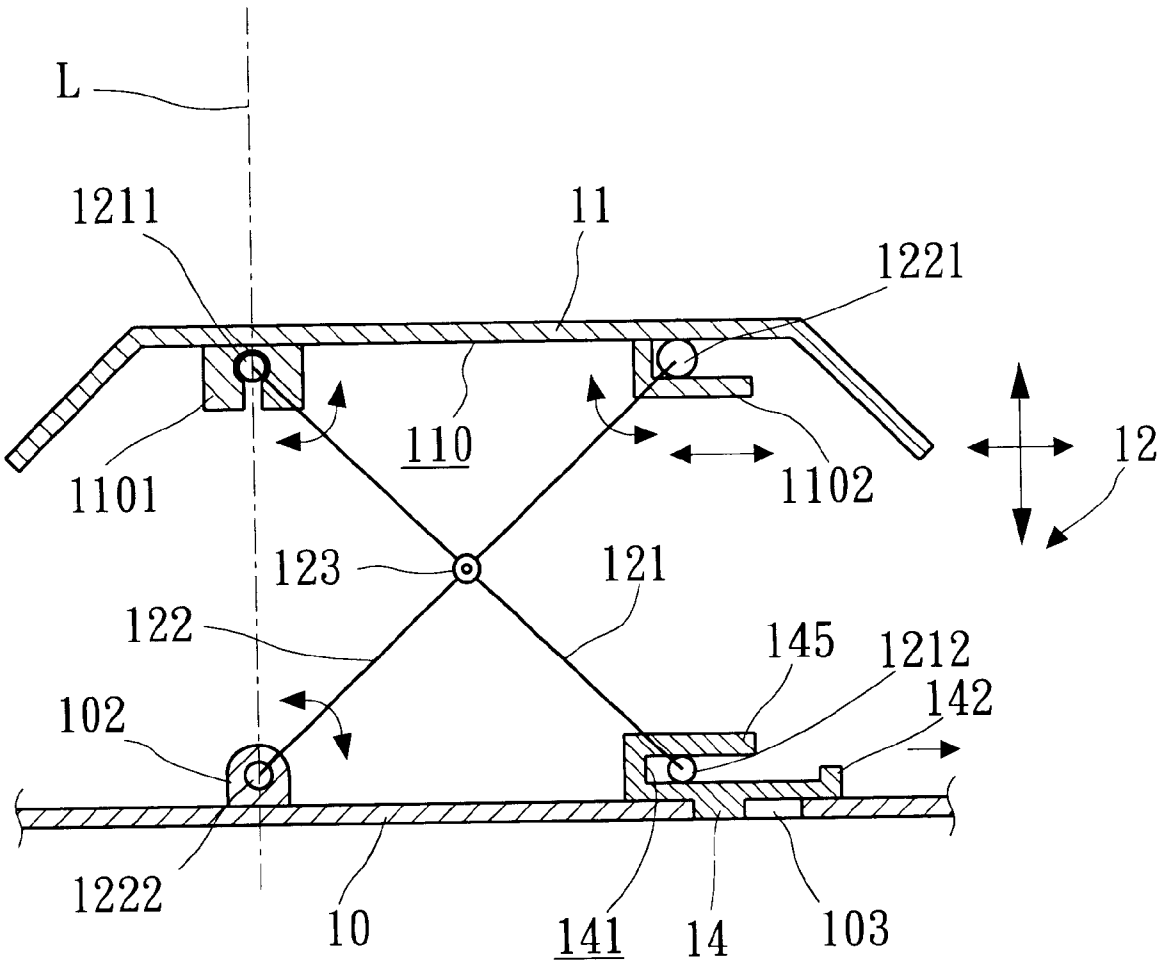
FIG. 4 is a sectional view of a second embodiment of this invention.

FIG. 4 shows a second embodiment which is largely constructed like the one shown in FIG. 3 except that the hub and flange 101 is combined with the stopper 14. The flange 101 becomes an upper beam 145 and the bordering edge 141 also serves as the vertical wall. It may function equally well with a simpler structure.

Figure 5:
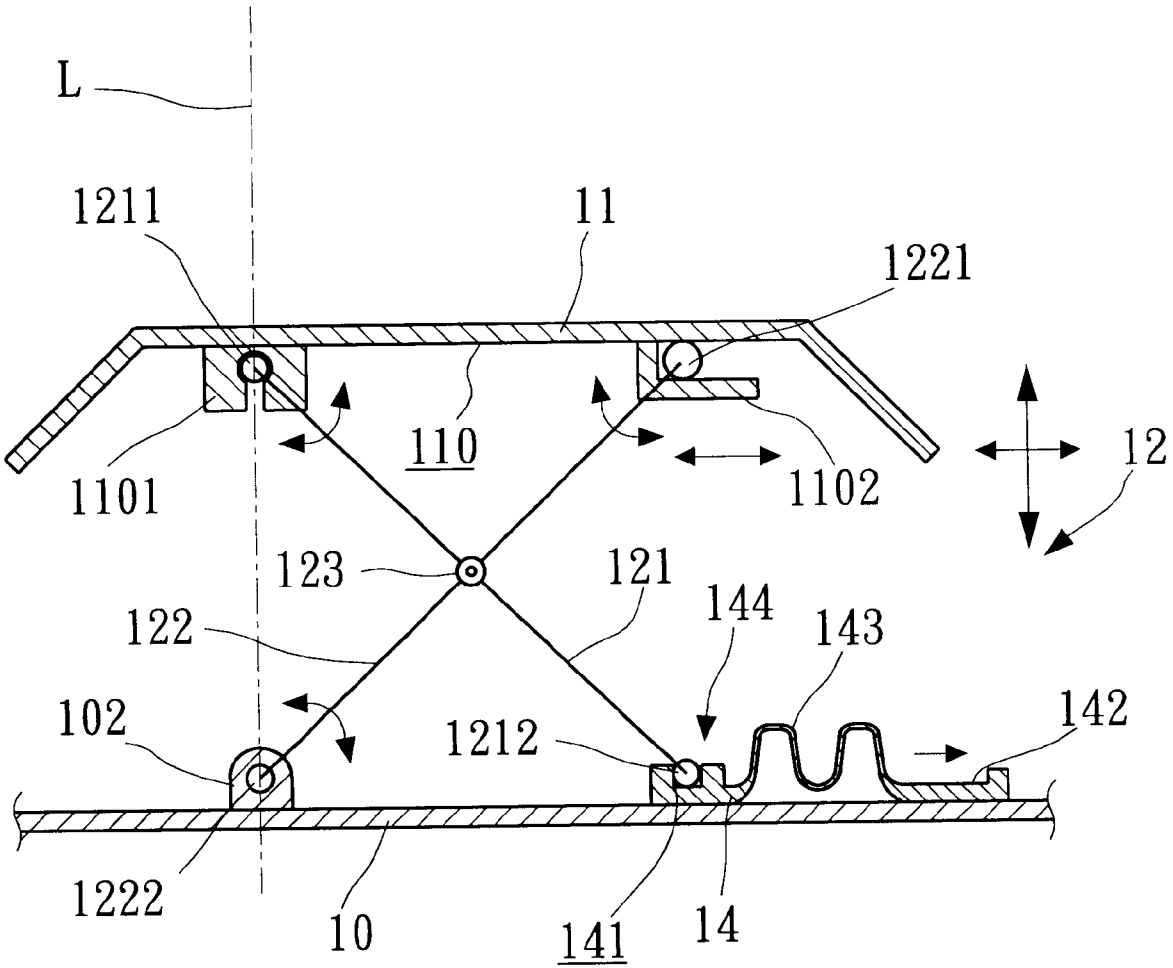
FIG. 5 is a sectional view of a third embodiment of this invention.
Figure 6A:
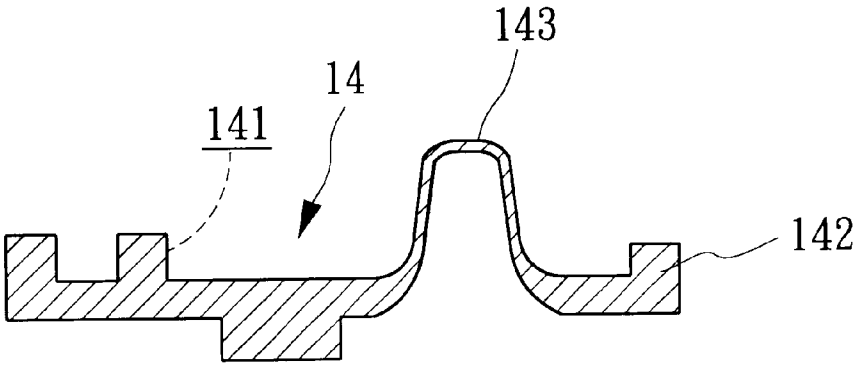
FIG. 6A is a sectional view of an embodiment of a stopper of this invention.
Figure 6B:
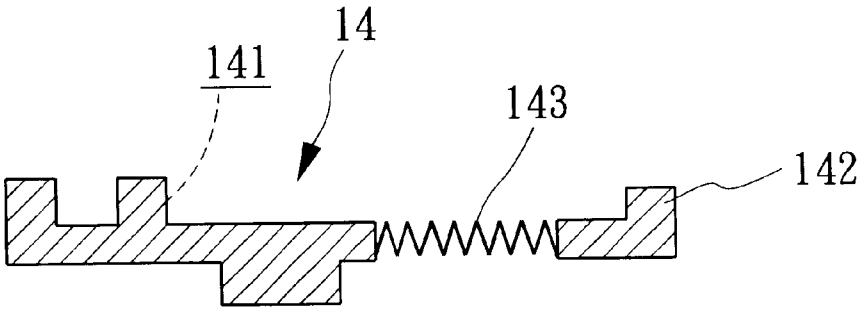
FIG. 6B is a sectional view of another embodiment of a stopper of this invention.

FIG. 5 shows a third embodiment which is largely constructed like the one shown in FIG. 4. However, the hub has a seat 144 to pivotally hold the first bottom end 1212 and connects with the adjusting end 142 through a resilient member 143. When the key top 11 is depressed downward by an external force, the first bottom end 1212 will be pushed outward on the substrate 10 and squeeze the resilient member 143 in the first direction to reduce the free height H to a desired level. When external force is absent, the resilient member 143 will be automatically restored and push the first bottom end 1212 back to its original position and restoring the key top 11 at the original free height. Obviously, upon using this invention, the rubber dome 13 used in the conventional button key (FIG. 1) may be omitted. The resilient member may be made in various forms by different materials, such as corrugated metallic strip (FIG. 5 and 6A), springs (FIG. 6B) and the likes. The stopper 14, the adjusting end 142 and the resilient member 143 may be separately made before assembled, or may be integrally formed.

Figure 7A:
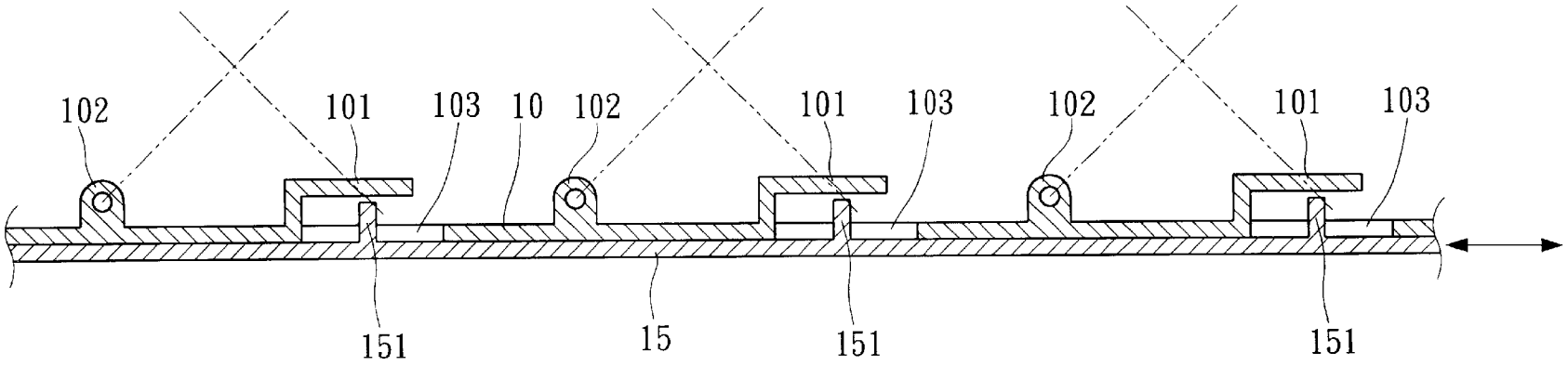
FIG. 7A is a fragmentary sectional view of a fourth embodiment of this invention.
Figure 7B:
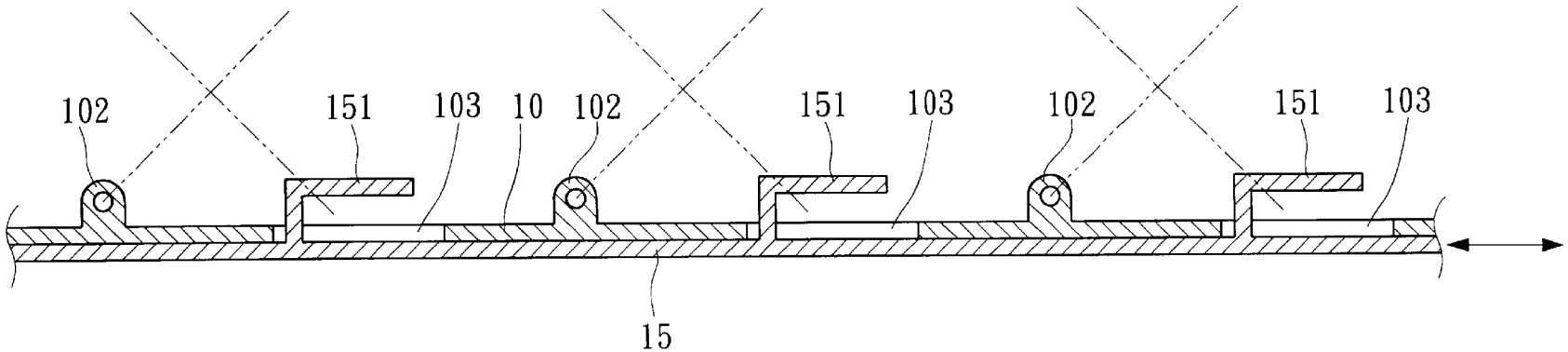
FIG. 7B is a fragmentary sectional view of a fifth embodiment of this invention.
Figure 7C:
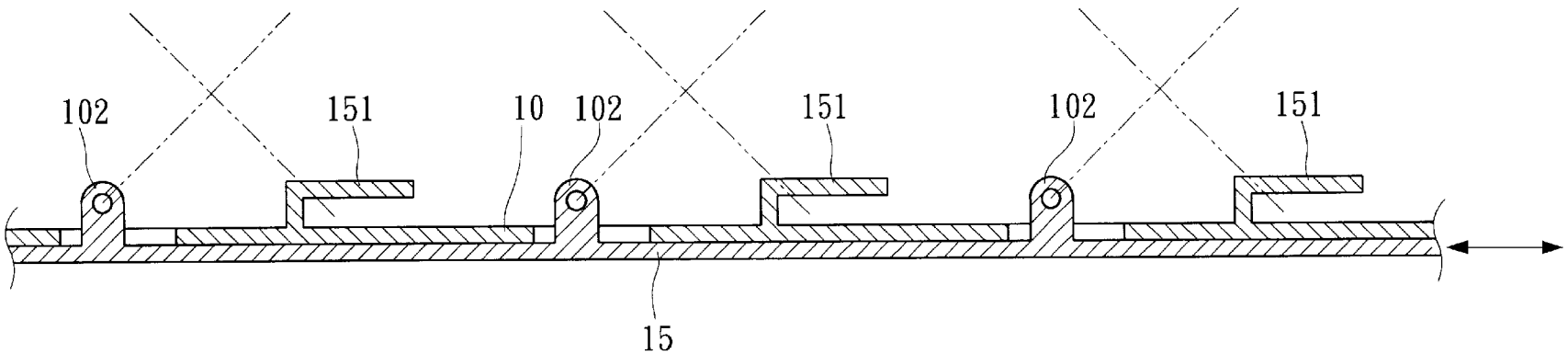
FIG. 7C is a fragmentary sectional view of a sixth embodiment of this invention.

This invention may be used for a single or more than one button key. It may even be used for the entire keyboard. FIG. 7A shows a fourth embodiment in which the substrate 10 is overlapped with a height-adjusting board 15 which has a plurality of vertical arms 151 extending out of the slide grooves 103 formed in the substrate 10 below the flanges 101. This embodiment can be seen as a multiple version of the first embodiment shown in FIG. 3. Moving the height-adjusting board 15 sideward to change relative position of the arms 151 against the hubs 102 may change the free height of all keys mounted on the substrate 10 simultaneously. Applying the same principle by moving the relative horizontal position of the substrate 10 against the height-adjusting board 15 may achieve the same result. FIG. 7B is a fifth embodiment which is substantially a variation of FIG. 7A but employing the structure shown in FIG. 4, with the upper arms 151 to replace the upper beam 145. FIG. 70 shows a sixth embodiment which is a variation of FIG. 7B. In the sixth embodiment, the upper arms 151 are located on the substrate 10 while the fourth hubs 102 are located on the height-adjusting board 15. By the same token, there may be many other variations that can perform the same function equally well, and all these variations are within the scope of the present invention.

Figure 8A:
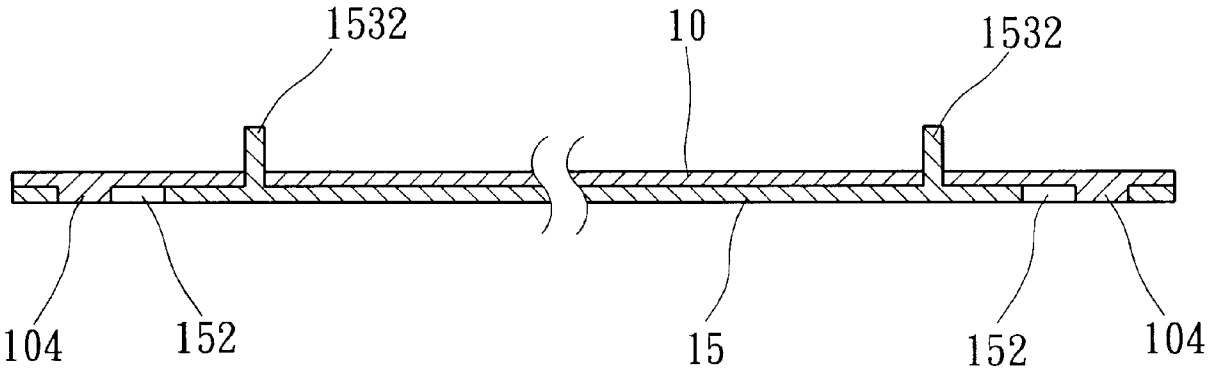
FIG. 8A is a fragmentary sectional view of an embodiment of a height-adjusting board and substrate of this invention;.
Figure 8B:
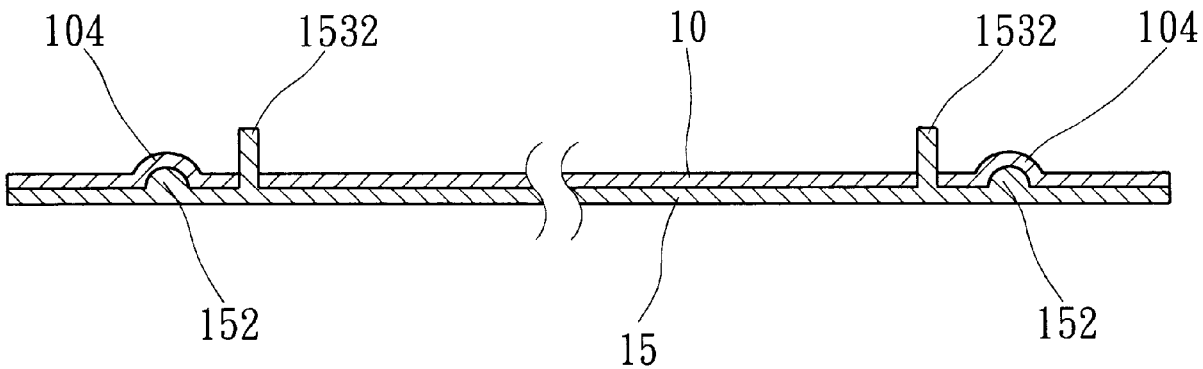
FIG. 8B is a fragmentary sectional view of another embodiment of a height-adjusting board and substrate of this invention.

For the entire height-adjusting board 15 to move smoothly against the substrate 10 used in the embodiment fourth (FIG. 7A) and embodiment fifth (FIG. 7B), FIG. 8A shows a feature of this invention in which a plurality of rails 104 extended downward from the substrate 10 may be engageable and movable in the slide means 152 (in this case, grooves) formed in the height-adjusting means 15. FIG. 8B shows another embodiment which is largely like the one shown in FIG. 8A, except that the rails 104 are extended upward from the substrate 10 engageable and movable above the bulged slide means 152 formed on the height-adjusting means 15. In practice, the movement of the height-adjusting board 15 needs an actuation means 153. This actuating means 153 may be located at any proper location on the lever, but preferably at the bottom ends of the lever adjacent to the substrate 10, particularly that the first bottom end 1212 will not be obstructive to the motion of the height-adjusting board 15.

Figure 9:
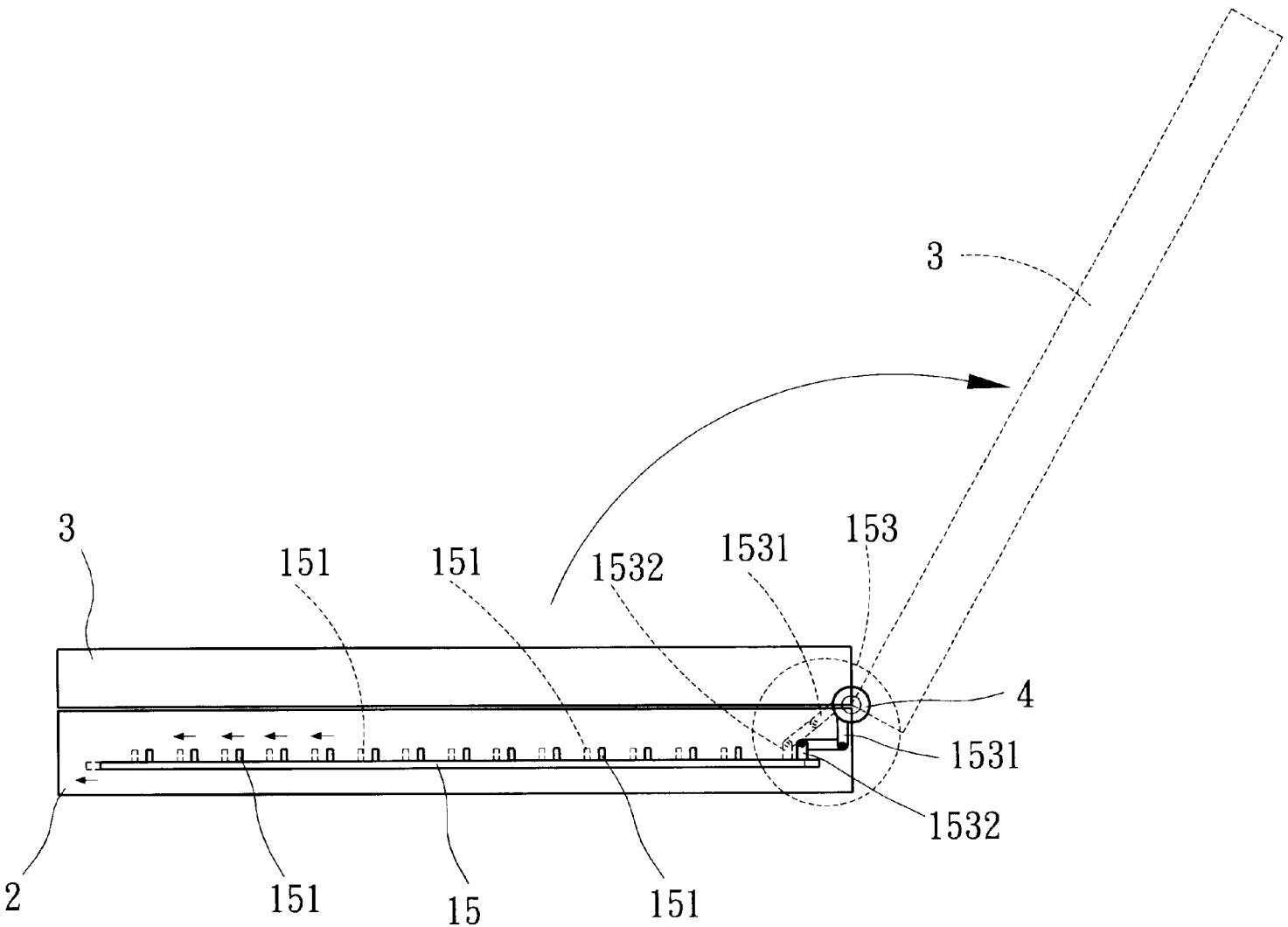
FIG. 9 is a schematic side view of the fourth embodiment of this invention shown in FIG. 7A used in a notebook computer.

FIG. 9 shows an example of this invention (embodiment shown in FIG. 7A or 7B) used in a notebook computer. The notebook computer has a body 2 pivotally engaged with a display screen 2 through a hinge 4. The height-adjusting board 15 has an actuation means 153 which includes a driver end 1531 attached to the display screen 2 and a driven end 1532 attached to the body 2. When the display screen 3 is closed and folded over the body 2 (shown by solid lines in FIG. 9), the driven end 1532 is driven by the driver end 1531 to move the height-adjusting board 15 against the substrate 10 so that all button keys will be moved to a lower free height position. Thus, the entire keyboard may be lowered into the body 2 for forming a slim and compact size for the whole computer set. When in use, the display screen 3 will be lifted to open, the driver end 1531 will move the driven end 1532 which in turn moves the height-adjusting board 15 against the substrate 10 to raise the keys to a greater height level for users to operate more comfortably.

Figure 10:
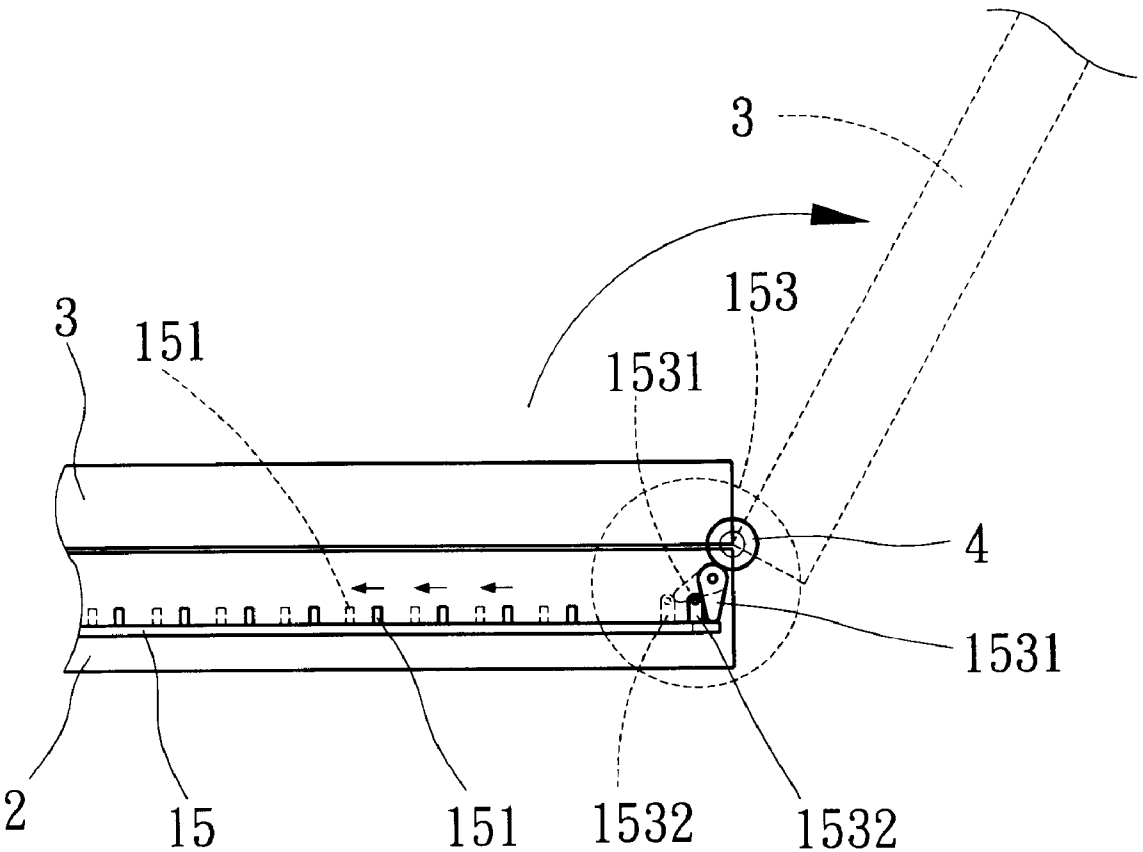
FIG. 10 is a schematic side view of another embodiment of a height-adjusting board and actuating means for this invention.

In the FIG. 9 example, the actuation means 153 consists of bar-type linkage. Yet, in the present invention, various linkages may also be suitable to achieve the same result. As one of the variations, FIG. 10 shows another example which uses a cam mechanism for the actuation means 153.

The substrate 10 in this invention may be a single layer board or a composite board consisting of multiple layers such as that been disclosed in the prior arts in U.S. Pat. Nos. 5,463,195 and 5,399,822.

While the embodiments set forth above deploy this invention on the juncture of the bottom end of the first lever 121 and substrate 10, it may be deployed equally well on the juncture of the second lever 122 and the substrate 10.

Aforesaid embodiments of this invention use two pairs of the first and the second levers 121 and 122 to form two collapsible means 12 so that there are four upper ends to support the button key and four lower ends to engage with the substrate 10. The button key thus may be supported securely and steadily even under repetitive hitting operation. However, the two first bottom ends 1212 may also be bound together. By the same token, the second bottom ends 1222 may also be bound together to form a two-bottom end collapsible means.

In summary, this invention enables the free height of the button key or the entire keyboard to be increased or decreased in a simple way so that the notebook computer may be made slim and compact when not is use, but has a higher key top level when in use to add users' comfort.

It may thus be seen that the objects of the present invention set forth herein, as well as those made apparent from the foregoing description, are efficiently attained. While the preferred embodiments of the invention have been set forth for purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A height-adjusting collapsible mechanism for a button key, comprising:

a key top;

a substrate formed with a slide groove of predetermined size;

a collapsible mechanism between the key top and the substrate, the collapsible mechanism having a first lever crossly engaged with a second lever at a pivotal point for supporting the key top so as to vertically move up and down relative to the substrate during use, the first and the second levers having respectively first and second bottom ends, the first and the second bottom ends being spaced from each other by an interval; and a stopper received in the slide groove and movable relative to the substrate between a first location and a second location, a distance between the first and second locations being determined by a size of the slide groove, at least one of the first and second bottom ends engaged with but movable relative to the stopper, the stopper further having a bordering edge located in said interval and in contact with the bottom end engaged with the stopper;

wherein, when the stopper moves from the first location to the second location, the bordering edge moves the bottom end engaged therewith so as to change the interval between the first and second bottom ends, thereby changing a vertical up and down movement distance between the top key and the substrate.

2. The height-adjusting collapsible mechanism of claim 1, wherein the substrate further has a horizontal flange protruding out of a top surface of the substrate so as to be located above and partially covering the slide groove, said stopper and said engaged bottom end being received between the horizontal flange and the top surface of substrate.

3. The height-adjusting collapsible mechanism of claim 1, wherein said stopper engaged an adjusting end whereby, providing an external force to the adjusting end, the stopper can be moved between the first and second locations, and the maximum movable distance of the stopper is defined by the size of slide groove.

4. The height-adjusting collapsible mechanism of claim 3, wherein said stopper engages said adjusting end by a resilient device.

5. The height-adjusting collapsible mechanism of claim 4, wherein said resilient device is a spring.

6. The height-adjusting collapsible mechanism of claim 4, wherein said stopper, said adjusting end and said resilient device are integrally formed.

7. A height-adjusting collapsible mechanism for a button key, comprising:

a key top;

a substrate;

a collapsible mechanism between the key top and the substrate, the collapsible mechanism having a first lever crossly engaged with a second lever thereof at a pivotal point for supporting the key top so as to vertically move up or down relative to the substrate during use, the first and the second levers having respectively first and second bottom ends, the first and the second bottom ends being spaced from each other by an interval; and a stopper located on the substrate and movable relative to the substrate in a horizontal direction between a first location and a second location, at least one of the first and second bottom ends being pivotally engaged with the seat, the stopper being integrally formed by a metallic plate, the resilient device is formed by a corrugated portion of said metallic plate to form a corrugated metallic strip portion for providing resilient force;

wherein, when the stopper moves from the first location to the second location, the seat moves the bottom end engaged therewith so as to change the interval between the first and second bottom ends, thereby changing a vertical up and down movement distance between the key top and the substrate.

8. A height-adjusting keyboard, comprising:

a substrate, having a plurality of spaced hubs extending upwardly;

a plurality of collapsible mechanisms for button keys being located on the substrate in a selected pattern, each collapsible mechanism including a key top and a plurality of collapsible devices, each collapsible device having a pair of levers pivotally crossed with each other to form a cross angle therebetween and a free height for the key top when a first external forcing is absent from the key top, the key top being movable up and down when subjected to said first external force which changes the cross angle;

a height-adjusting board, laid horizontally and movably under the substrate and having a plurality of arms extending upwardly through the substrate and spaced from the hubs by an interval, the pairs of levers each having two bottom ends engageable with the hubs and arms; and, the substrate further having at least one side rail with a mating slide on said height-adjusting board to horizontally move thereon;

wherein, by applying a second external force to the height-adjusting board, the height-adjusting board is moved to change a relative position of the same against the substrate, such that the interval will be changed for changing the free height of the key top.

9. The height-adjusting keyboard of claim 8, wherein said slide rail has a slide groove, and said slide is a protruding slide member movable in said slide groove.

10. The height-adjusting keyboard of claim 8, wherein said slide rail has a protruding slide rail, and said slide mates with the slide rail and is movable thereon.

11. The height-adjusting keyboard of claim 8, further comprising at least one actuation device receiving said second external force to change the relative position between said height-adjusting board and said substrate.

12. A keyboard for a notebook computer which has a display screen pivotally engaged with a body which holds the keyboard therein, comprising:

a substrate having a plurality of spaced hubs extending upward;

a plurality of collapsible mechanisms for button keys located on the substrate in a selected pattern, each collapsible mechanism including a key top and a plurality of collapsible devices, each collapsible device having a pair of levers pivotally crossed with each other to form a cross angle therebetween and a free height for the key top when a first external forcing is absent form the key top, the key top being movable up and down when subjected to the first external force which changes the cross angle;

a height-adjusting board, laid horizontally and movably under the substrate and having a plurality of arms extending upwardly through the substrate and spaced from the hubs by an interval, the pairs of levers each having two bottom ends engageable with the hubs and arms;

an actuation device, located in the body for receiving a second external force to change a relative position of the height-adjusting board against the substrate to change the interval for changing the free height of the key top; and said substrate further having at least one slide with a mating slide on said height-adjusting board to horizontally move thereon.

13. The keyboard for a notebook computer of claim 12, wherein said rail has a slide groove, and said slide mates with the slide groove and is movable therein.

14. The keyboard for a notebook computer of claim 12, wherein said rail has a protruding slide rail, and said slide mates with the slide rail and is movable therein.

15. The keyboard for a notebook computer of claim 12, wherein said actuation means includes a driver end attached to said display screen and a driven end attached to said height-adjusting board, the driver end moving the driven end and said height-adjusting board in a first direction to reach a lower free height when said display screen is closed and folded on said body, and the drive end moving the driven end and said height-adjusting board in a second direction to reach a higher free height when said display screen is lifted and opened away from said body.

16. The keyboard for a notebook computer of claim 12, wherein said actuating device includes a cam located in said body for moving said height-adjusting board to reach a higher free height when said display screen is lifted to open away from said body.

* * * * *